United States Patent [19]

Eckel et al.

[11] Patent Number: 4,480,552

[45] Date of Patent: Nov. 6, 1984

[54] CLUSTERED AMMUNITION EJECTABLE FROM CANISTERS

[75] Inventors: Alfred Eckel, Treuchtlingen; Manfred Kastenhuber, Rednitzhembach; Erich Bock, Nuremberg, all of Fed. Rep. of Germany

[73] Assignee: Diehl GmbH & Co., Nuremburg, Fed. Rep. of Germany

[21] Appl. No.: 422,398

[22] Filed: Sep. 24, 1982

[30] Foreign Application Priority Data

Oct. 3, 1981 [DE] Fed. Rep. of Germany ..... 3139473

[51] Int. Cl.[3] ..... F42B 25/16; F42B 13/50

[52] U.S. Cl. ..... 102/393; 102/489

[58] Field of Search ..... 102/393, 489, 454, 505

[56] References Cited

U.S. PATENT DOCUMENTS 2,434,162 1/1948 Imber ..... 102/393

2,972,946 2/1961 Poulter ..... 102/393

FOREIGN PATENT DOCUMENTS 2342211 7/1977 Fed. Rep. of Germany .

*Primary Examiner*—Charles T. Jordan

*Attorney, Agent, or Firm*—Scully, Scott, Murphy & Presser

[57] ABSTRACT

Clustered ammunition which is ejectable from canisters for the combating of ground targets, which includes a central body which is encompassed by the ammunition with a member for clustering the ammunition. The clustered ammunition is retained by a clamping band and is fixed in position through the intermediary of formed-fitted components.

2 Claims, 3 Drawing Figures

CLUSTERED AMMUNITION EJECTABLE FROM CANISTERS

BACKGROUND OF THE INVENTION

1. Field of the Invention

The present invention relates to clustered ammunition which is ejectable from canisters for the combating of ground targets, which includes a central body which is encompassed by the ammunition and with a member for clustering the ammunition.

2. Discussion of the Prior Art

From German Pat. No. 23 42 211 there has become known a projectile with clustered secondary projectiles. The secondary projectiles are retained about a central body through the intermediary of a band.

In clustered small bombs with impellers or wind vane generators arranged at the sides thereof, it is important that during the conveyance of the cluster or, in essence, of the small bombs, these cannot displace since otherwise the impeller generators will be slid out sideways to some extent and, as a result, can be damaged. The same prerequisite is applicable to the introduced guide mechanism for flight stabilization.

SUMMARY OF THE INVENTION

Accordingly, it is an object of the present invention to secure in a simple manner the clustered, cylindrical ammunition of scatter-fire weapons, such as small bombs, against rotation to thereby prevent damaging of constructional segments of the small bombs.

The foregoing object is inventively achieved in providing clustered ammunition wherein the ammunition which is retained by a clamping band is fixed in position through the intermediary of formed-fitted components.

Further advantageous features of the invention may be ascertained from the following detailed description as set forth hereinbelow.

The small bombs are securely fixed in position. Even an extremely high vibration load, such as can occur in aircraft, will not influence the securely fixed positioning. The small bombs are also prevented from displacing relative to each other inasmuch as each small bomb has a form-fitted component associated therewith. Hence, the small bombs form a form-fitting chain.

Through the fixed positioning it is possible in a simple manner to maintain the impeller or wind vane generators in a deactivated position. Consequently, this will obviate any latching means which would be required for this purpose. Only when the cluster of small bombs is released from the clamping band will there commence the ejection process of the up to now protectively positioned impeller generators.

BRIEF DESCRIPTION OF THE DRAWINGS

Reference may now be had to the description of an exemplary embodiment of the invention; taken in conjunction with the accompanying drawings; in which.

DETAILED DESCRIPTION

Figure 1:
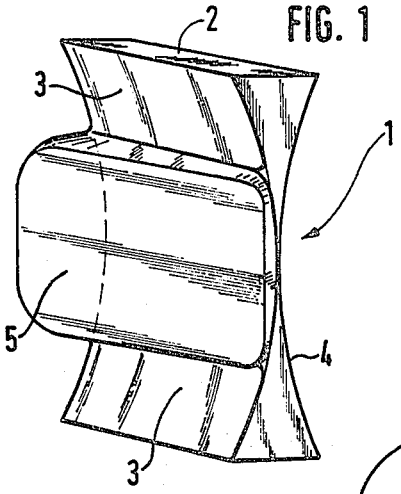
FIG. 1 illustrates a form-fitted component constructed as a latching device.
Figure 2:
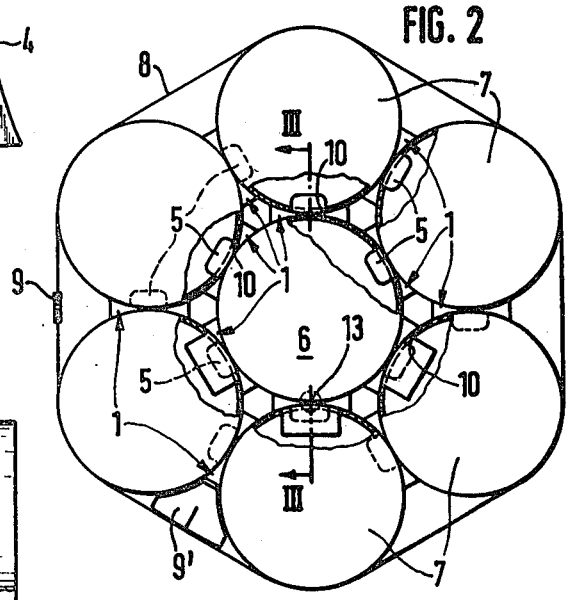
FIG. 2 illustrates clustered small bombs which are form-fittedly fixed in position by the latching device pursuant to FIG. 1.
Figure 3:
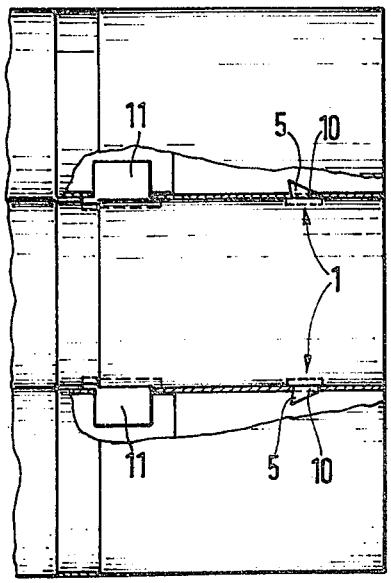
FIG. 3 is a sectional view taken along line III—III in FIG. 2.

A latching device 1 formed of aluminum is constructed in an X-shape and is provided with concave side walls 3, 4. Arranged on the side wall 3 is a projection 5 which is tapered on one side thereof.

Positioned about a centrally located small bomb 6 are further small bombs 7, and are retained together through a clamping band 8 with a closure 9 and a pyrotechnic separating arrangement 9'. Inserted between each of the small bombs 6, 7 are, respectively, latching devices 1.

The projections 5 each engage, respectively, in recesses 10 in the small bombs 6,7 which are provided therefore. Supported so as to be extendable are impeller or wind vane generators 11 in the small bombs 6, 7. These impeller generators 11 are located on the same generatrix 13 as are the latching devices 1 which are provided between the small bombs 6, 7.

During the ejection of the clustered small bombs 6,7 from an ammunition canister (not shown), the clamping band 8 is separated apart by the separating arrangement 9' in a manner which is not illustrated herein. The air resistance which acts on the small bombs 6,7 will cause these to separate from each other.

The latching devices 1 can exert a supplemental function. For this purpose, the latching devices which are located in the elevation of the guide mechanism will secure the wings in a retracted position.

Suitable as materials for the latching devices 1 are metals, such as steel, aluminum, or plastic materials, such as polyamides or rubber.

We claim:

1. In clustered ammunition ejectable from canisters for combating of ground targets, including a central body encompassed by the ammunition; and a member clustering the ammunition; the improvement comprising a clamping band retaining the ammunition; and form-fitted components for fixing said ammunition in position within said band, each of said form-fitted components being x-shaped and having concave side walls in conformance with the radii of the ammunition and said central body, each of said components including projections engageable in corresponding recesses in said ammunition.

2. Arrangement as claimed in claim 1, said projection being formed on the side wall of said form-fitted component.

* * * * *